US006516842B1

(12) United States Patent
Chang

(10) Patent No.: US 6,516,842 B1
(45) Date of Patent: Feb. 11, 2003

(54) HOLLOW CHISEL MORTISER WITH A ROTOR FOR ADJUSTING A WORKING ANGLE OF THE MORTISER

(76) Inventor: Wen-Chi Chang, No. 1111, Chungshan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/102,310

(22) Filed: Mar. 20, 2002

(30) Foreign Application Priority Data

May 26, 2001 (TW) ..... 90208816 U

(51) Int. Cl.[7] ..... B27F 5/02; B27C 3/00

(52) U.S. Cl. ..... 144/74; 144/82; 144/92; 144/103; 408/88; 408/98; 408/100; 408/110

(58) Field of Search ..... 144/69, 70, 74, 144/78, 82, 92, 93.1, 103, 104, 106, 84; 408/87, 88, 89, 98, 99, 100, 106, 107, 110

(56) References Cited

U.S. PATENT DOCUMENTS

| | | | | |
|---|---|---|---|---|
| 1,201,050 A | * | 10/1916 | Huff | 144/103 UX |
| 2,953,045 A | * | 9/1960 | Carles | 408/110 |
| 3,119,286 A | * | 1/1964 | Forman et al. | 144/106 X |
| 3,329,043 A | * | 7/1967 | Stanford | 144/93.1 |

* cited by examiner

*Primary Examiner*—W. Donald Bray
(74) *Attorney, Agent, or Firm*—Hedman & Costigan, P.C.

(57) ABSTRACT

A hollow chisel mortiser with a rotor for adjusting a working angle of the mortiser includes a base having a recess defined in a rear end of the base. The rotor rotatably abuts and is selectively secured on the rear end of the base. The rotor includes a protrusion extending from the rotor and rotatably received in the recess. A worktable is slidably mounted on the base. A tool support is perpendicularly mounted on the rotor. A drill is movably mounted on the support. The working angle of the drill can be easily adjusted by rotating the rotor.

5 Claims, 10 Drawing Sheets

34
33
341
31
341
321
357
32
323
322
324
325
358
37
355
35
37
36

HOLLOW CHISEL MORTISER WITH A ROTOR FOR ADJUSTING A WORKING ANGLE OF THE MORTISER

BACKGROUND OF THE INVENTION

1. Field of the Invention

The present invention relates to a hollow chisel mortiser, and more particularly to a hollow chisel mortiser with a rotor for adjusting a working angle of the mortiser.

2. Description of Related Art

With reference to FIGS. 7 and 8, a conventional hollow chisel mortiser in accordance with the prior art comprises base (11), a worktable (12), a tool support (16), a drill (18) and a lever (17). The base (11) has a flat bottom adapted to be connected to another surface and a top. The worktable (12) is movably mounted on the top of the base member (11). A flat (13) is formed on one end of the top of the base (11). The tool support (16) is mounted on and secured to the flat (13) by bolts (15) and washers (14) perpendicular to the worktable (12). The drill (18) with a motor (not numbered) is slidably mounted on the tool support (16). The lever (17) is rotatably mounted on the tool support (16) to selectively drive the drill (18) downward. The conventional hollow chisel mortiser does not have an adjusting device so the conventional woodworking drill press can only drill perpendicularly holes in a workpiece.

With reference to FIGS. 9 and 10, an improved conventional hollow chisel mortiser is provided and comprises base (23), a mounting shaft (22) and a worktable (21). The mounting shaft (22) has two ends. One end is securely mounted in or attached to the base member, and the worktable (21) is rotatably mounted on the other end of the shaft (22). The position of the worktable (21) can be adjusted on the shaft (22) so that the improved conventional hollow chisel mortiser can drill an inclined hole (25) in a workpiece (24).

However, the worktable (21) is mounted on the free end of the mounting shaft (22) so that the mounting shaft (22) carries all the weight of the worktable (21) and the workpiece (24). Consequently, the shaft (22) is easily deformed or broken.

The present invention has arisen to mitigate and/or obviate the disadvantages of conventional hollow chisel mortisers.

SUMMARY OF THE INVENTION

The main objective of the present invention is to provide an improved hollow chisel mortiser with a rotor for adjusting a working angle of the drill.

To achieve the objective, the hollow chisel mortiser in accordance with the present invention includes a base having a recess defined in a rear end of the base. The rotor rotatably abuts and is selectively secured on the rear end of the base. The rotor includes a protrusion that extends from the rotor and is rotatably received in the recess. A worktable is slidably mounted on the base. A tool support is radially mounted on the rotor. A drill is movably mounted on the support. The working angle of the mortiser can be easily adjusted by rotating the rotor.

Further benefits and advantages of the present invention will become apparent after a careful reading of the detailed description with appropriate reference to the accompanying drawings.

DETAILED DESCRIPTION OF THE INVENTION

Figure 1:
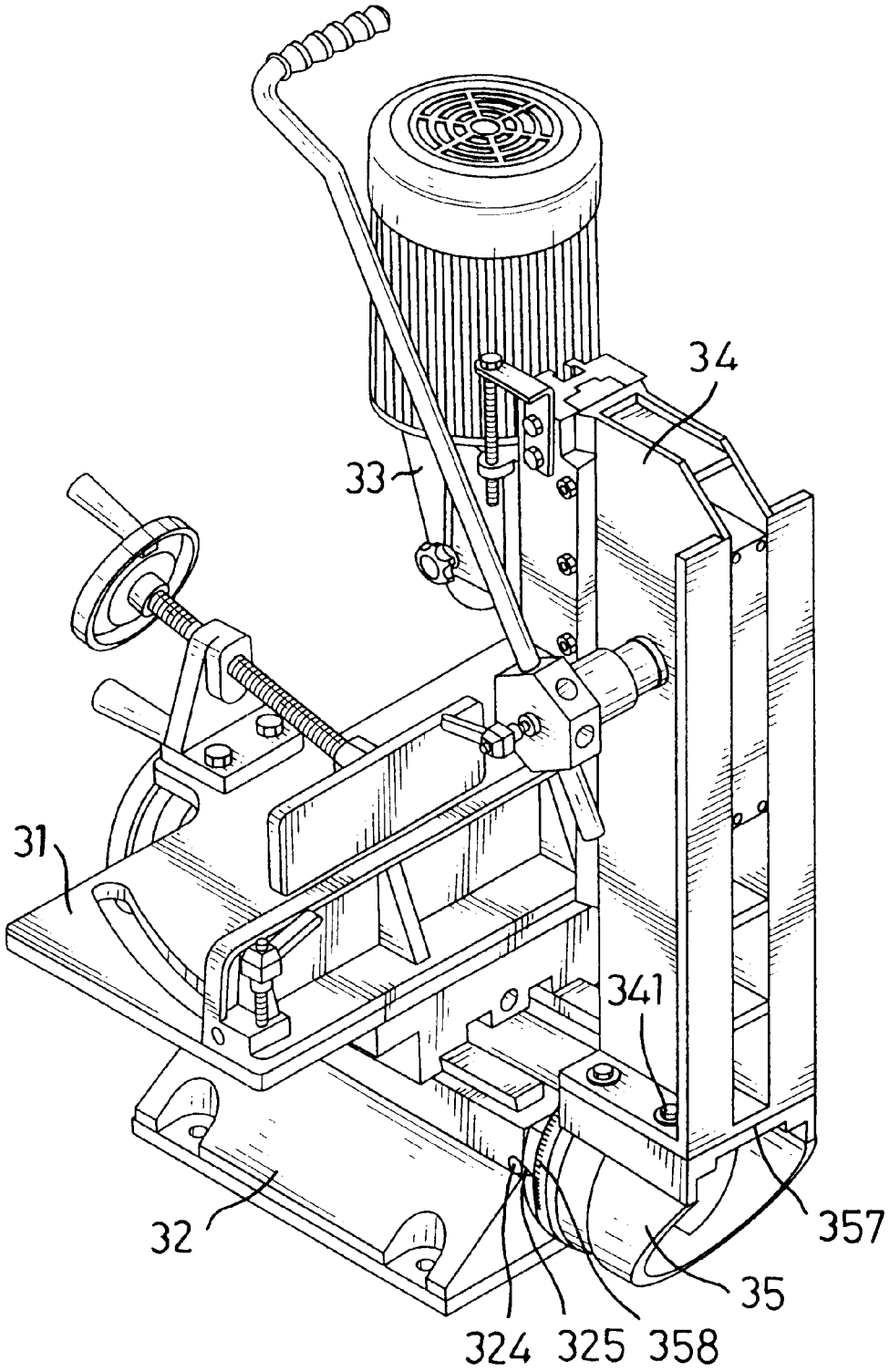
FIG. 1 is a perspective view of a hollow chisel mortiser with a rotor in accordance with the present invention.
Figure 2:
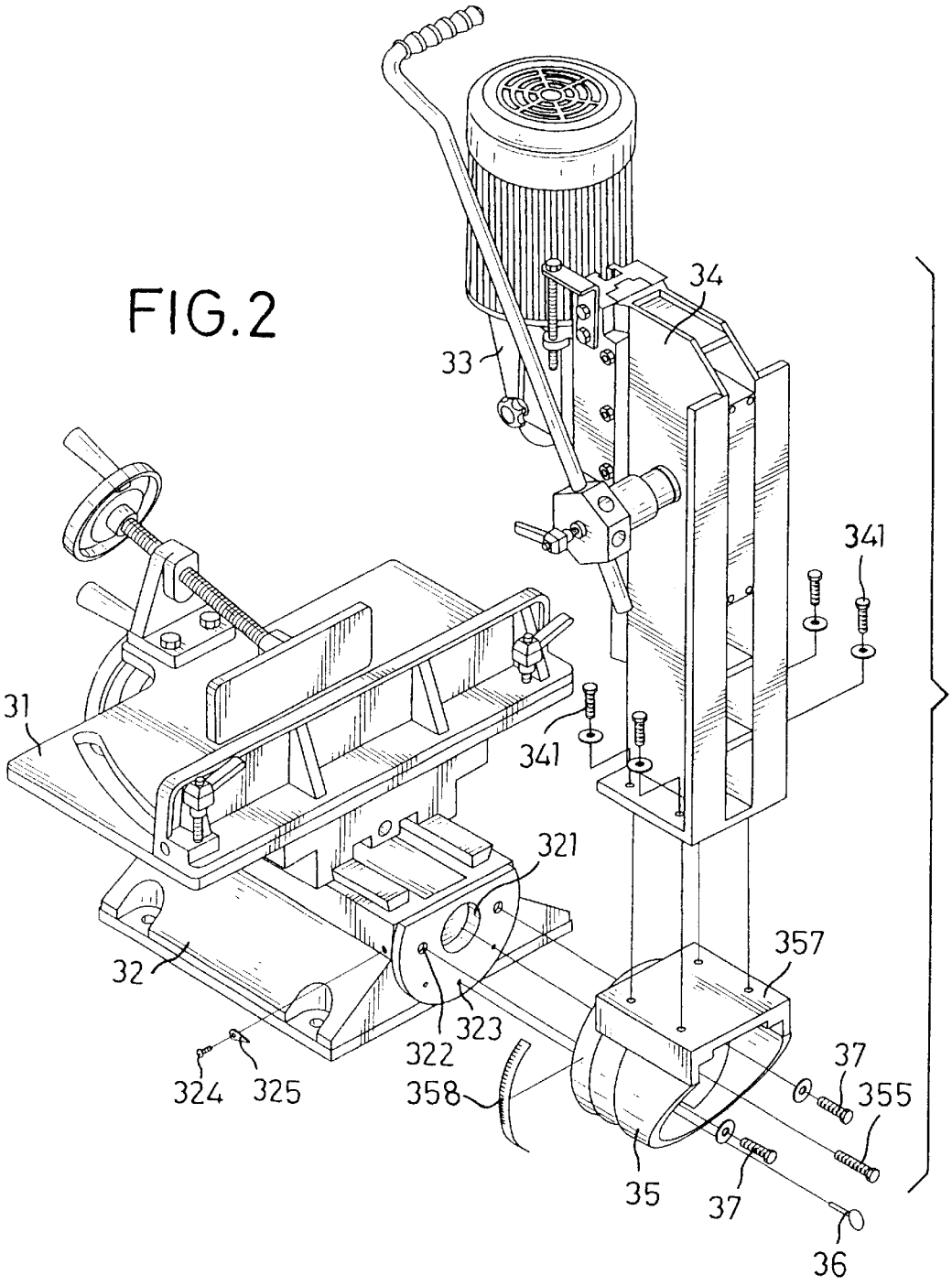
FIG. 2 is a partially exploded perspective view of the hollow chisel mortiser in FIG. 1.
Figure 2A:
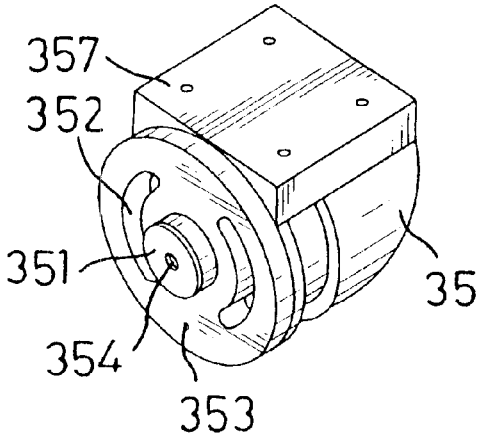
FIG. 2A is a perspective view of the rotor in the hollow chisel mortiser in FIG. 1.
Figure 3:
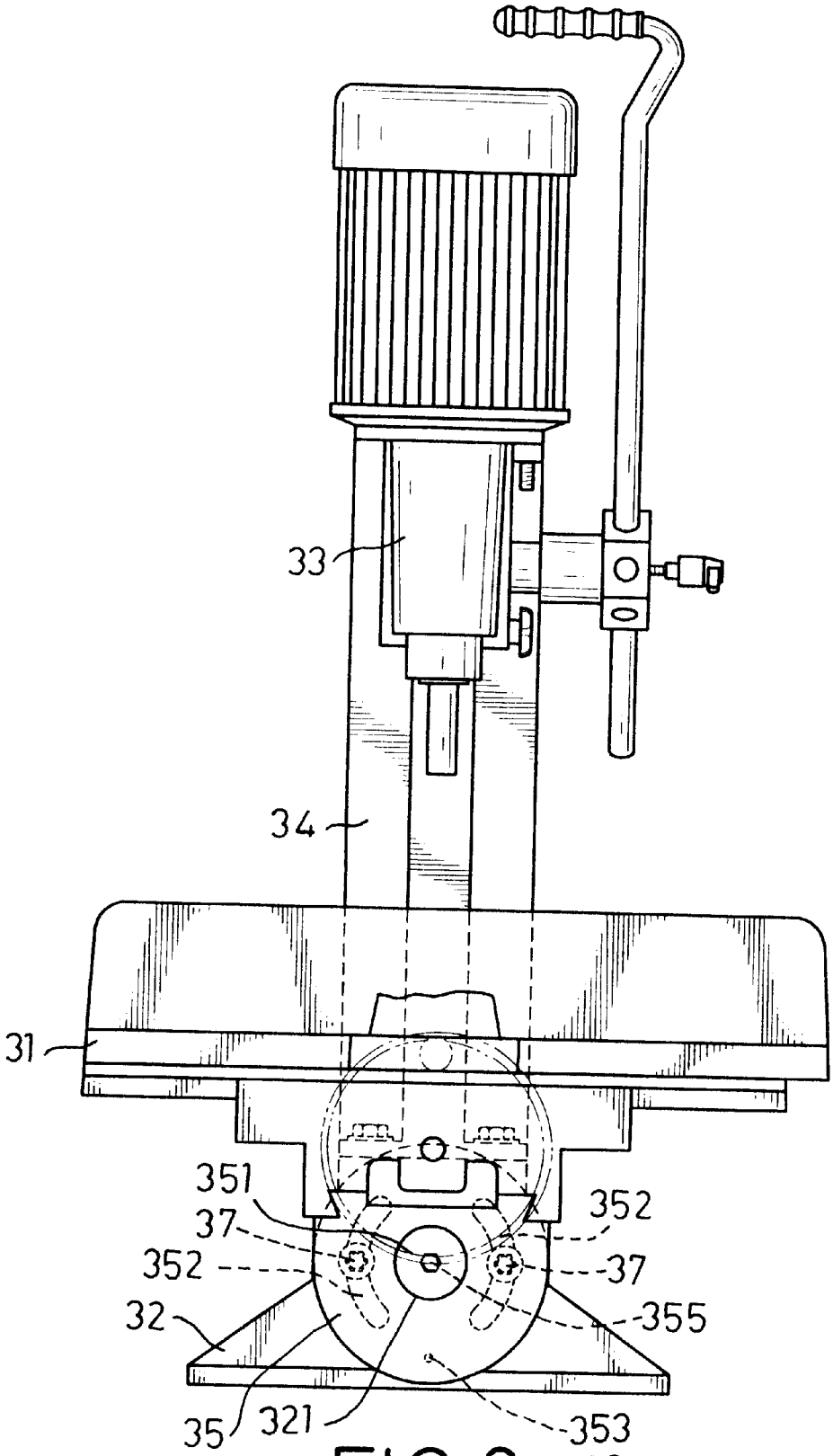
FIG. 3 is a front plan view of the hollow chisel mortiser in FIG. 1.

With reference to the drawings and initially to FIGS. 1, 2, 2A and 3, a hollow chisel mortiser with a rotor in accordance with the present invention comprises a base (32), a worktable (31) a rotor (35), a tool support (34) and a drill (33). The base (32) has a bottom adapted to be connected to another surface, a front, a rear end and a top adapted to mount the worktable (31). The worktable (31) is slidably mounted on the top of the base (32). The rotor (35) is rotatably mounted on the rear end of the base (32). The tool support (34) is radially mounted on the rotor (35). The drill (33) is slidably mounted on the tool support (34).

The base (32) includes a flat (not numbered) formed on the rear end of the base (32) perpendicular to the bottom of the base (32). A recess (321) is longitudinally defined in the flat, and two threaded holes (322) are diametrically defined in the flat relative to the recess (321). Multiple locking-pin holes (323) are longitudinally defined in the flat under the recess (321) and radial relative to the recess (321). An indicator (325) is attached to the base (32) by a bolt (324) and partially extends over the flat on the base (32).

Figure 4:
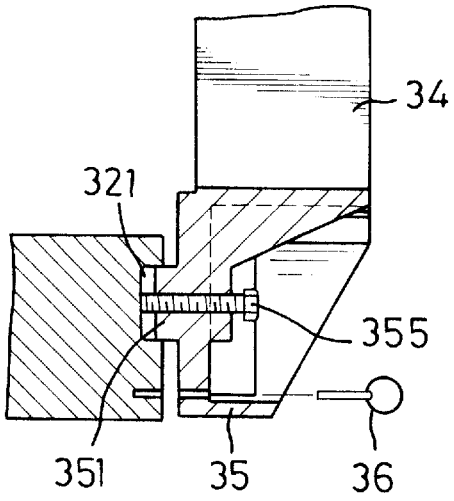
FIG. 4 is a cross sectional side plan view of the rotor in FIG. 2.

The rotor (35) includes a first flat (not numbered) formed to abut the flat on the base (32) and a protrusion (351) extending from the first flat on the rotor (35) and rotatably inserted into the recess (321) in the base (32). The protrusion (351) has a diameter slightly smaller than that of the recess (321). Two curved slots (352) are defined in the first flat on the rotor (35) and extend through the rotor (35). The two curved slots (352) respectively correspond to the two threaded holes (322) in the flat on the base (32). A pinhole (353) is defined in the first flat of the rotor (35) and extends through the rotor (35). The pinhole (353) in the rotor (35) selectively aligns with one of the corresponding locking-pin holes (323) in the base member (32). A through hole (354) is coaxially defined in the protrusion (351). A bolt (355) rotatably extends through the through hole (354) in the protrusion (351) of the rotor (35) and is screwed into a bottom of the recess (321) in the base member (32). Two screws (37) respectively extend through the corresponding curved slots (352) in the rotor (35) and screw into the threaded holes (322) in the flat in the base (32) to attach the rotor (35) to the base (32). With further reference to FIG. 4, a locking pin (36) extends through the pinhole (353) in the rotor (35) and is inserted into the locking-pin hole (323) in the base (32) to hold the rotor (35) in place when the two screws (37) are loosed. A scale (358) is attached to the rotor (35) and corresponds to the indicator (325) so a user can read the working angle of the drill (18) with respect to the worktable (31). A second flat (357) is formed on a top of the rotor (35) and is perpendicular to the first flat of the rotor (35).

The tool support (34) is mounted on the second flat (357) and secured by multiple bolts (341) extending through the tool support (34) and screwed into the second flat (357) of the rotor (35).

Figure 6:
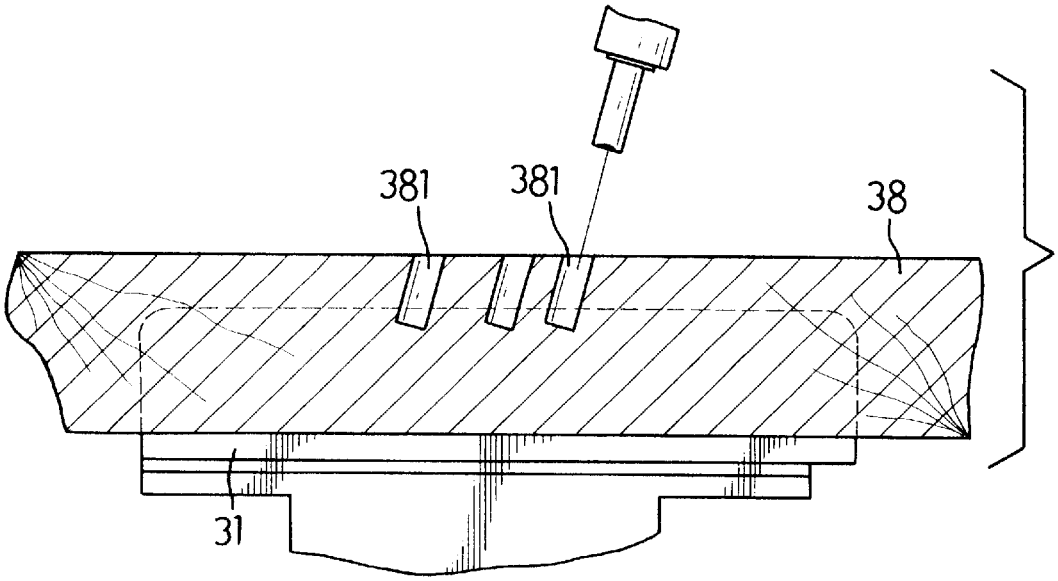
FIG. 6 is an enlarged operational front plan view of the hollow chisel mortiser in FIG. 1.
Figure 5:
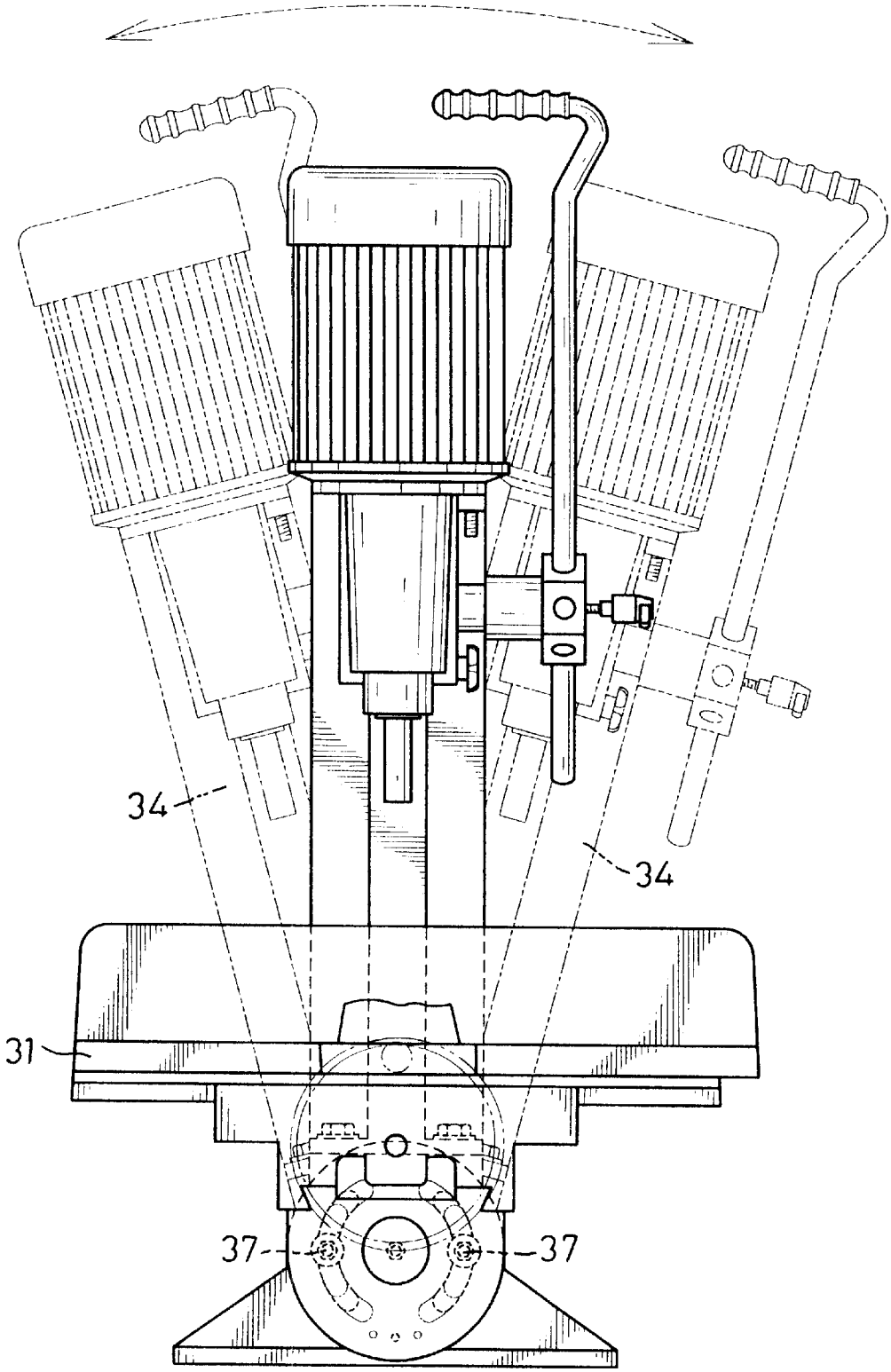
FIG. 5 is an operational front plan view of the hollow chisel mortiser in FIG. 1.
Figure 7:
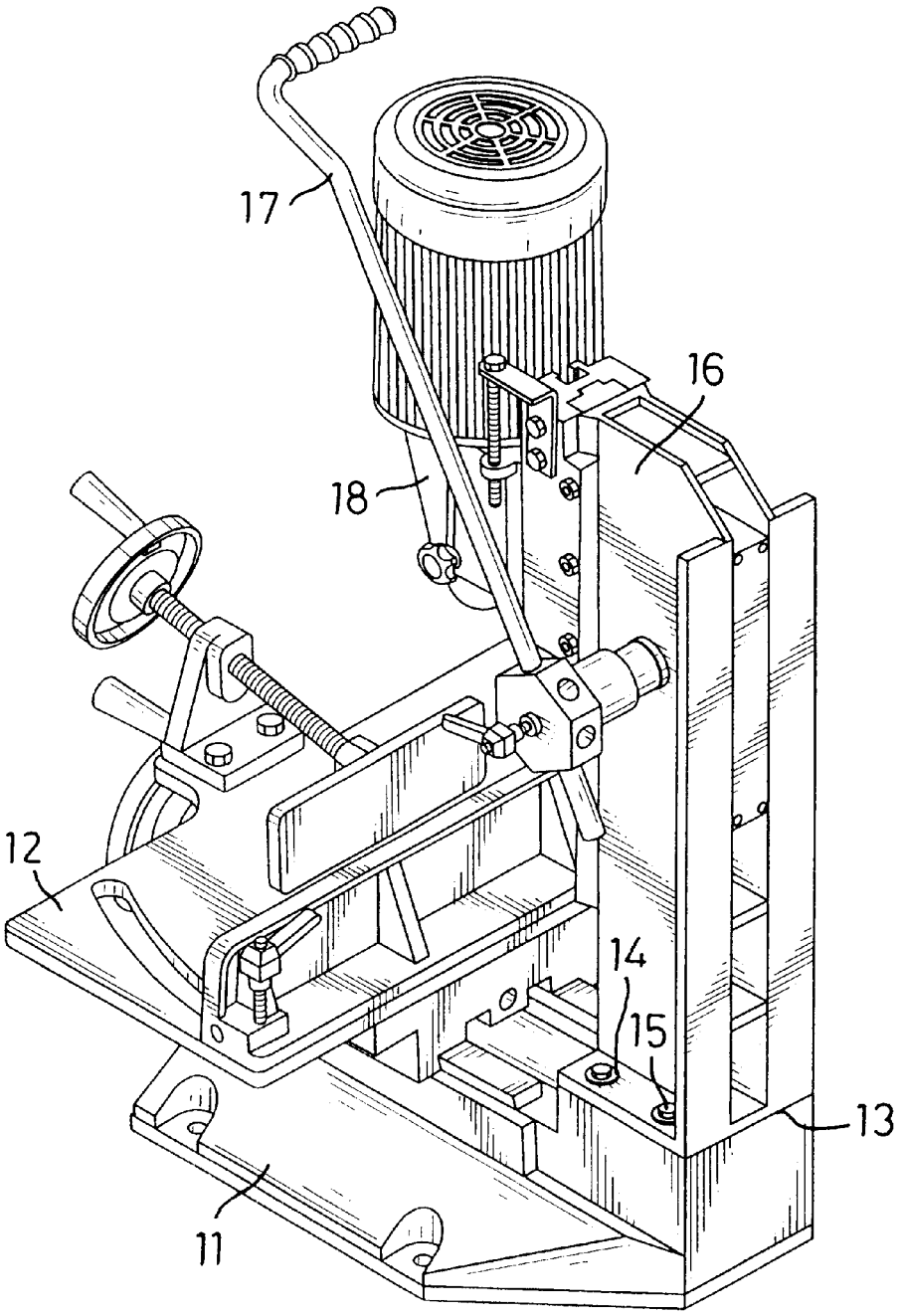
FIG. 7 PRIOR ART
FIG. 7 is a perspective view of a conventional hollow chisel mortiser in accordance with the prior art.
Figure 8:
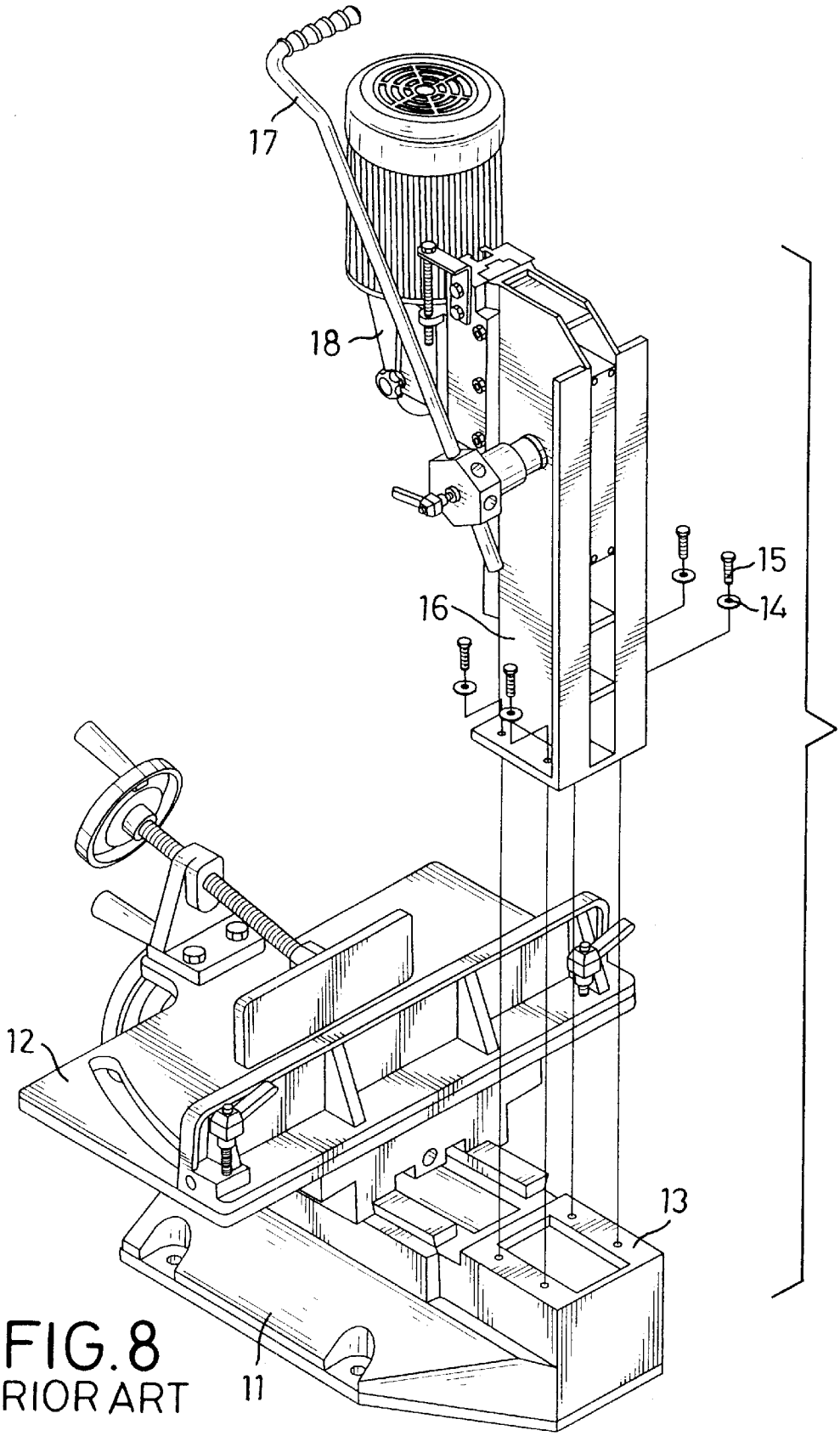
FIG. 8 PRIOR ART
FIG. 8 is a partially exploded perspective view of the conventional hollow chisel mortiser in FIG. 7.
Figure 9:
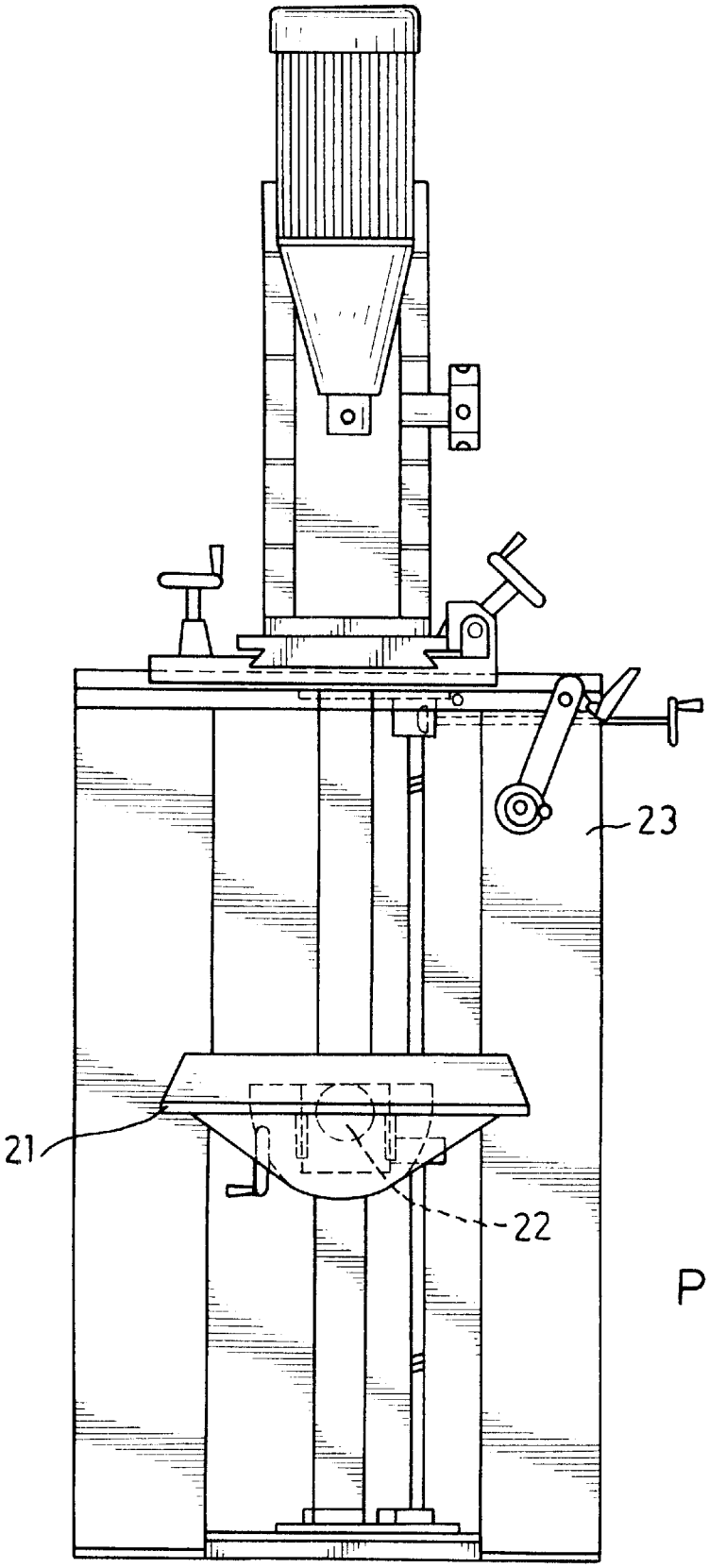
FIG.9 PRIOR ART
FIG. 9 is front plan view of another conventional hollow chisel mortiser in accordance with the prior art.
Figure 10:
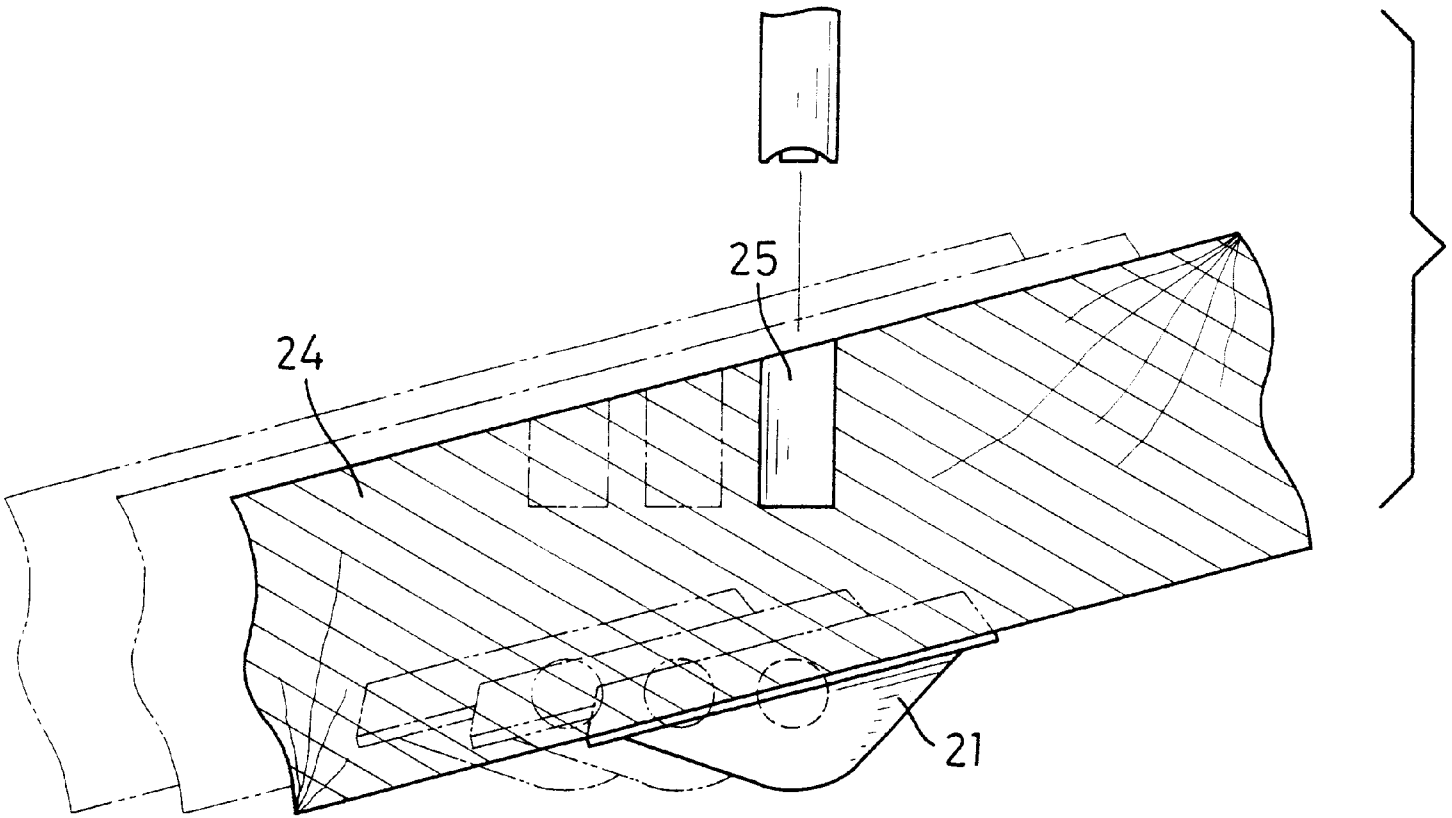
FIG.10 PRIOR ART
FIG. 10 is an enlarged front plan view of the conventional hollow chisel mortiser in FIG. 9.

With reference to FIGS. 5 and 6, the two screws (37) are loosed when adjusting the working angle of the drill (18). The user can easily read the working angle from the scale (358) due to the indicator (325). The two screws (37) are tightened again when the tool support (34) is adjusted to a suitable angle.

As previously described, the working angle of the drill (18) is easy to read and adjust. A user only needs to loose two screws (37) to adjust the working angle of the drill (18), and the locking pin prevents the tool support (34) from suddenly swinging when the two screws (37) are loosed.

Although the invention has been explained in relation to its preferred embodiment, it is to be understood that many other possible modifications and variations can be made without departing from the spirit and scope of the invention as hereinafter claimed.

What is claimed is:

1. A hollow chisel mortiser with a rotor for adjusting a working angle of the mortiser, comprising:

a base with a bottom adapted to be secured to another surface, a top, a front and a rear end including a recess longitudinally defined in the rear end of the base member and two threaded holes diametrically defined in the rear end of the base member relative to the recess in the base member;

a rotor rotatably abutting and selectively secured on the rear end of the base, the rotor including:

a protrusion axially extending from the rotor and rotatably received in the recess in the base member;

two curved slots defined in and extending through the rotor, the two curved slots respectively aligning with the two threaded holes in the base member;

a through hole co-axially defined in the protrusion and extending through the rotor;

a bolt extending through the through hole and screwed into the base; and two screws extending through the two curved slot in the rotor and screwed into the two threaded holes in the base to attach the rotor to the base;

a worktable slidably mounted on the top of the base;

a tool support perpendicularly mounted on the rotor; and a drill movably mounted on the support.

2. The hollow chisel mortiser as claimed in claim 1, wherein the rotor has a flat formed on a top of the rotor and the tool support is mounted on the flat of the rotor.

3. The hollow chisel mortiser as claimed in claim 1, wherein the base includes an indicator secured on the base member by a bolt screwed into the base, and the rotor has a scale attached to the rotor corresponding to the indicator on the base so a user can read the working angle of the drill.

4. The hollow chisel mortiser as claimed in claim 2, wherein the base member includes an indicator secured on the base by a bolt screwed into the base, and the rotor has a scale attached to the rotor corresponding to the indicator on the base so a user can read the working angle of the drill.

5. The hollow chisel mortiser as claimed in claim 2, wherein the base has multiple locking-pin holes longitudinally defined in the rear end of the base, and the rotor has a pinhole defined in the rotor, the pinhole in the rotor selectively aligning with the locking-pin holes in the base.

* * * * *